US009557082B1

(12) United States Patent
Colburn et al.

(10) Patent No.: US 9,557,082 B1
(45) Date of Patent: Jan. 31, 2017

(54) APPARATUS FOR CONVERTING HOT AIR AND STEAM EMISSIONS INTO COOLER AIR AND CONDENSATE

(71) Applicant: IWD Holdings, LLC, Burlington, VT (US)

(72) Inventors: Michael G. Colburn, Burlington, VT (US); Stephen J. Bogner, Colchester, VT (US)

(73) Assignee: SA Vent, LLC, Providence, RI (US)

( * ) Notice: Subject to any disclaimer, the term of this patent is extended or adjusted under 35 U.S.C. 154(b) by 0 days.

(21) Appl. No.: 14/707,334

(22) Filed: May 8, 2015

Related U.S. Application Data

(60) Provisional application No. 61/992,839, filed on May 13, 2014.

(51) Int. Cl.

| | |
|---|---|
| ***F25D 21/00*** | (2006.01) |
| ***F25B 21/02*** | (2006.01) |
| ***F25D 21/14*** | (2006.01) |
| ***F24C 15/20*** | (2006.01) |
| ***F25B 39/04*** | (2006.01) |
| ***F25B 49/02*** | (2006.01) |

(52) U.S. Cl.
CPC ..... *F25B 21/02* (2013.01); *F24C 15/2035* (2013.01); *F25B 39/04* (2013.01); *F25B 49/02* (2013.01)

(58) Field of Classification Search
CPC ..... A47J 36/38; F25B 21/02; F25B 39/04; F25C 15/20; F25C 15/2007; F25C 15/2035
USPC ..... 62/272, 3.2, 3.4, 150, 285, 286
See application file for complete search history.

(56) References Cited

U.S. PATENT DOCUMENTS

| | | | | | |
|---|---|---|---|---|---|
| 3,675,442 | A | * | 7/1972 | Swanson | 62/285 |
| 4,129,179 | A | * | 12/1978 | Molitor | 165/101 |
| 4,941,400 | A | * | 7/1990 | Moore | 99/403 |
| 4,957,520 | A | * | 9/1990 | Parmentier et al. | 96/136 |
| 5,161,548 | A | * | 11/1992 | Neville | 131/296 |
| 5,211,159 | A | * | 5/1993 | Lieblein et al. | 126/299 R |
| 5,454,296 | A | * | 10/1995 | Beardsley et al. | 99/403 |
| 5,715,696 | A | * | 2/1998 | Salvagno et al. | 62/272 |

(Continued)

OTHER PUBLICATIONS

Market Forge Industries Inc., Vega Condenser Hood, Market Forge Industries Inc., 2014, Burlington, Vermont.

(Continued)

*Primary Examiner* — Ryan J Walters
*Assistant Examiner* — Joseph Tripsovsky
(74) *Attorney, Agent, or Firm* — Thomas G. Ference

(57) ABSTRACT

A stand alone venting apparatus for an enclosed space that converts open door and closed door emissions of a steam and hot air oven into cooler air and condensate, the apparatus comprising an expansion chamber, a condensing chamber and a chilling chamber. A capture hood is provided for capturing the open door emissions. An emissions inlet is provided for capturing the closed door emissions. The condensing chamber includes condensing tubes with each tube containing an interior and an exterior. The open door emissions are directed over the exterior of the condensing tubes and the closed door emissions are directed within the interior of the condensing tubes. The expansion chamber and chilling chambers work with the condensing chamber to further cool and condense the emissions. All emissions may be re-circulated back into the enclosed space without requiring ductwork to vent outside the enclosed space.

23 Claims, 10 Drawing Sheets

(56) References Cited

U.S. PATENT DOCUMENTS

| | | | | |
|---|---|---|---|---|
| 5,761,908 | A * | 6/1998 | Oas et al. | 62/3.2 |
| 5,956,965 | A * | 9/1999 | Watanabe et al. | 62/389 |
| 8,522,770 | B2 | 9/2013 | Colburn et al. | |
| 2007/0204978 | A1* | 9/2007 | Beamer | 165/124 |
| 2009/0071346 | A1* | 3/2009 | Saksena et al. | 99/330 |
| 2013/0145775 | A1* | 6/2013 | Orem | 62/3.4 |

OTHER PUBLICATIONS

Market Forge Industries Inc., Vega Condenser Hood for Altair II Steamer—Installation—Operation, Market Forge Industries Inc., 2014, Burlington, Vermont.

* cited by examiner

APPARATUS FOR CONVERTING HOT AIR AND STEAM EMISSIONS INTO COOLER AIR AND CONDENSATE

RELATED APPLICATIONS

This application claims the benefit of priority of U.S. Provisional Patent Application No. 61/992,839, filed May 13, 2014, which is herein incorporated by reference.

FIELD

This patent application generally relates to an apparatus for converting hot air and steam emissions into cooler air and condensate. More specifically it relates to a stand alone venting apparatus including an expansion chamber, a condensing chamber and a chilling chamber; the apparatus is capable of treating emissions from multiple exhaust outlets.

BACKGROUND

In commercial foodservice operations, supermarkets and other confined-space food preparation environments; food cooking and heating equipment can create undesirable air conditions when not properly vented. Untreated exhaust emissions from the equipment can be unacceptably warm, include smoke, grease and particulates that are unpleasant and unhealthy. In order to insure a healthy and safe environment for confined spaces, regulatory agencies monitor the installation of equipment and require that emissions generated from heating and cooking equipment be treated to acceptable levels before exhausting.

To ensure air quality, food exhaust emissions are usually treated with ventilation boxes (vents or hoods) that are suspended over all equipment and the emissions removed by ductwork to the exterior of the building. These ventilation systems are very expensive. They require extensive ducting and penetration through building structures. Grease and particles may buildup on the interior of the ductwork, requiring further expensive cleaning, which if not done adequately on a regular basis may result in fires.

Recently there have been developments in localized appliance venting whereby exhaust emissions are adequately treated and re-circulated back within a building structure. One such example is described in U.S. Pat. No. 8,522,770 to Colburn et. al. These appliances require that smoke, particulates, odor and grease be adequately removed from the air to a suitable level in order to return the air back into the building in a condition where the air is safe, healthy and pleasant. These appliances have saved a great deal of money and inconvenience compared to earlier solutions; however, they only work with certain types of food treatment equipment.

The use of steam cooking equipment utilizing both hot air and steam (combination ovens) has seen a dramatic increase in the last decade. These steam cooking appliances are versatile, have reduced processing times and produce healthy food. They are generally larger than standard ovens, but they can also exist as countertop equipment. The appliances are often used in locations other than central kitchens due to their flexibility and stand-alone functionality. They are also often used in multiple locations throughout a facility. This presents a challenge when trying to implement traditional venting that has ductwork to the outside of the building. The installation of that ductwork can be prohibitively expensive when trying to install the ducted venting at remote and multiple locations throughout a facility. In addition to emissions of grease, volatile oils, water vapor, odor, heat and sometimes smoke that is seen in a traditional oven, these appliances also emit a large amount of steam that requires treating and a drain for condensate. The steam must be condensed to water when vented from the oven and the condensed water must be cooled to less than 82° C. before reaching drain piping. Grease, smoke and odor from the air and steam must be removed before returning air to the enclosed environment. A further complication for these combination ovens is that the steam, hot air and particulates vent from multiple outlets; a sealed exhaust outlet connected to the oven and a different location when the door is opened. A venting solution must adequately capture and treat emissions from both of these exhaust locations.

This present patent application provides for an apparatus that converts hot air and steam emissions into cooler air and condensate. The apparatus is also capable of treating emissions from multiple exhaust sources.

SUMMARY

One aspect of the present patent application is directed to an apparatus for converting hot air and steam emissions into cooler air and condensate. The apparatus comprises a housing including an expansion chamber. An emissions inlet is provided to deliver the hot air and steam to the expansion chamber. A condensing chamber is located within the housing and receives hot air and steam from the expansion chamber. A chilling chamber is located within the housing and receives the hot air and steam from the condensing chamber. A condenser outlet exits the chilling chamber to exhaust cooler air and condensate.

Another aspect of the present patent application is directed to an apparatus for treating open door and closed door emissions of a steam and hot air oven. The apparatus comprises a housing integrated with a capture hood, the capture hood for capturing the open door emissions of the steam and hot air oven. An emissions inlet is integrated with the housing, the emissions inlet for capturing the closed door emissions of the steam and hot air oven. The apparatus also comprises a condensing chamber within the housing; the condensing chamber includes condensing tubes with each tube containing an interior and an exterior. The open door emissions are directed over the exterior of the condensing tubes and the closed door emissions are directed within the interior of the condensing tubes.

Yet another aspect of the present patent application is directed to an apparatus for controlling exit temperature of condensate and air. The apparatus comprises a chilling chamber for holding condensate, steam and air. The chilling chamber has a chilling surface for chilling air and a bottom surface for collecting the condensate. A condensate outlet exits the chilling chamber at the bottom surface. A thermoelectric device is in thermal contact with the chilling surface. The thermoelectric device is for removing heat from the chilling surface. The apparatus further comprises a temperature sensor and a switch. The switch receives temperature information from the temperature sensor. The switch uses the temperature sensed by the temperature sensor to turn on and off the thermoelectric device to keep the condensate temperature below a specified value.

Still yet another aspect of the present patent application is directed to a condensate switching device. The condensate switching device comprises a condensate reservoir for holding a quantity of condensate. The condensate reservoir has a vertical wall with a drain opening located at a vertical height. The vertical height determines a set level of condensate contacting a condensate temperature sensor. The condensate temperature sensor is integrated to sense condensate temperature. The condensate temperature sensor is activated when condensate touches the temperature sensor. A switch is in communication with the condensate temperature sensor. The switch has an ON high-temperature state and an OFF low-temperature state, the temperature of the condensate activates the switch.

BRIEF DESCRIPTION OF DRAWINGS

The foregoing and other aspects and advantages presented in this patent application will be apparent from the following detailed description, as illustrated in the accompanying drawings, in which.

DETAILED DESCRIPTION

Figure 1:
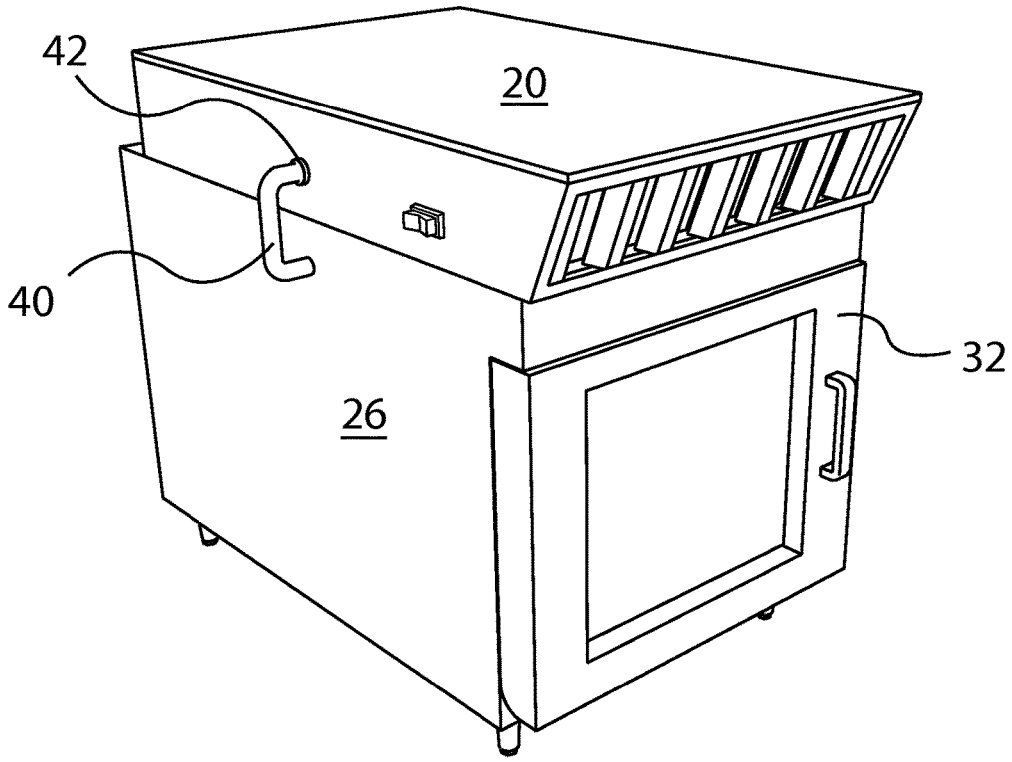
FIG. 1 is a front-side, perspective view of a venting apparatus according to the present invention, the apparatus integrated with a combination steam and hot air oven.
Figure 2:
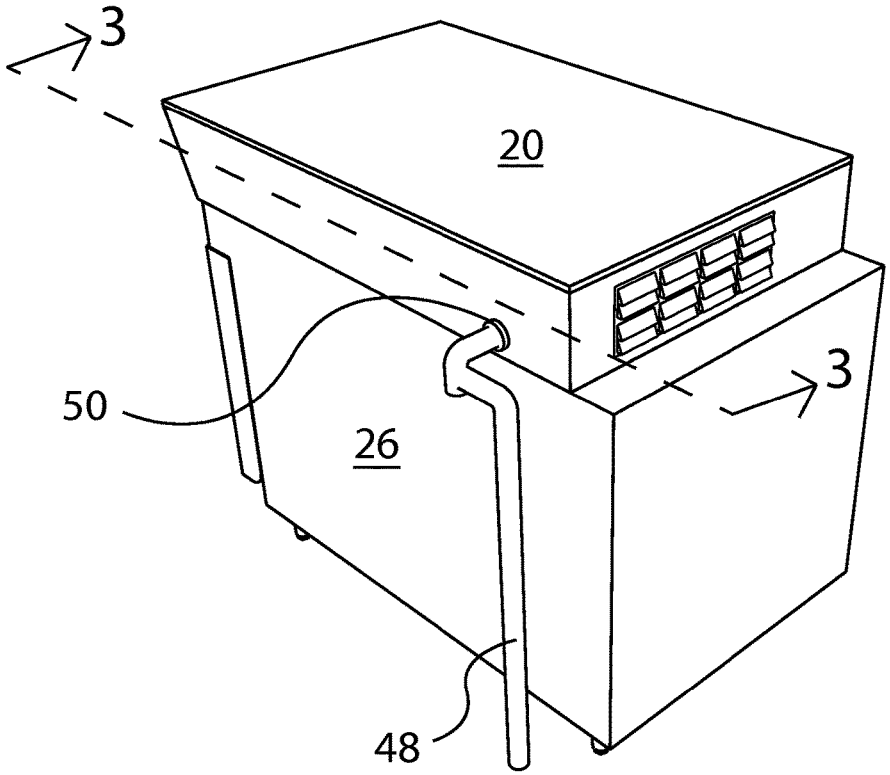
FIG. 2 is a back-side, perspective view of the integrated venting apparatus in FIG. 1.
Figure 3:
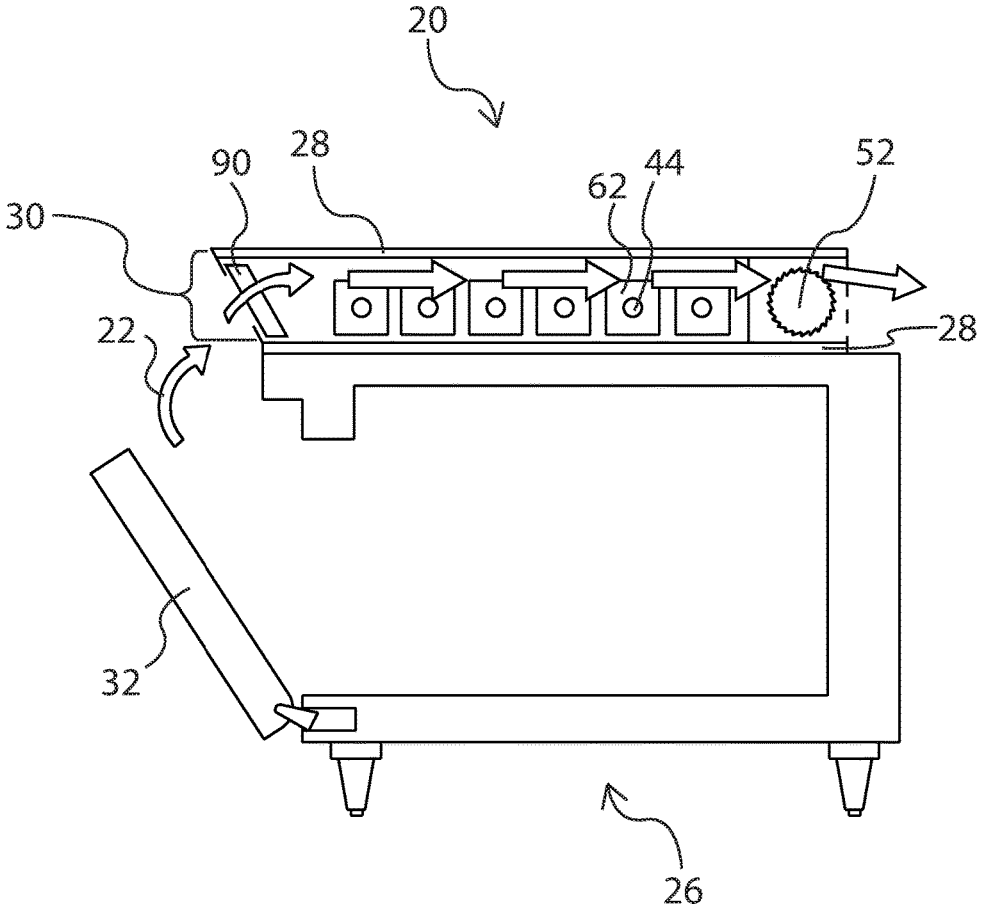
FIG. 3 is a sectional, view of the integrated venting apparatus in FIG. 2 along line 3-3.
Figure 4:
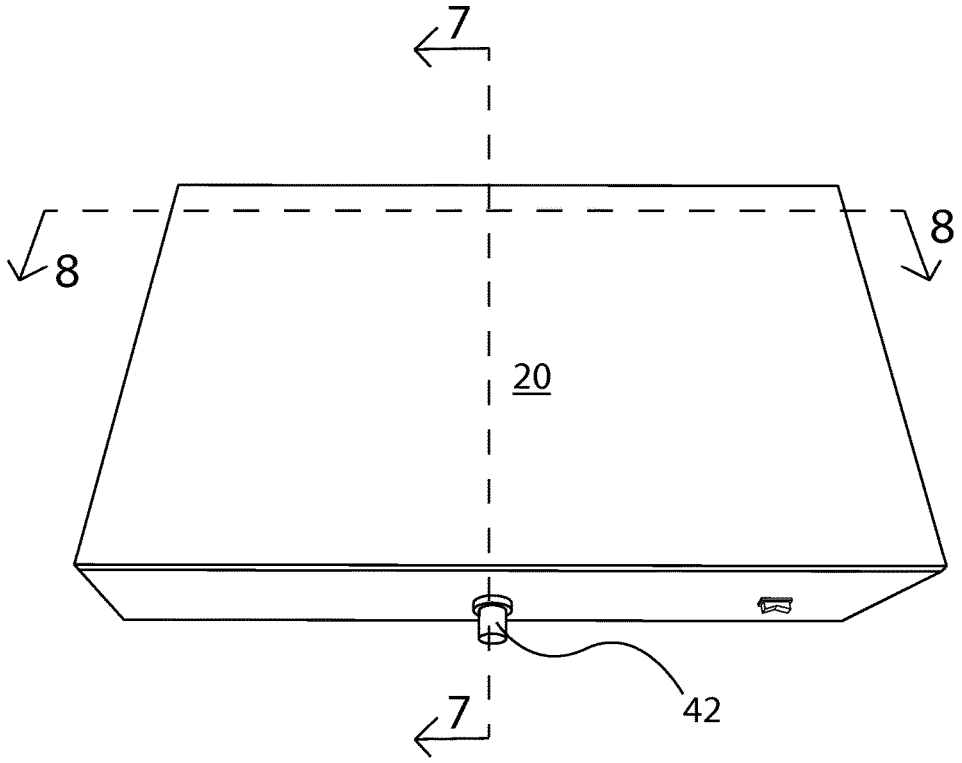
FIG. 4 is a top-side, perspective view of the venting apparatus in FIG. 1.

Apparatus 20 for treating open door emissions 22 and closed door emissions 24 from a combination hot air and steam oven 26 is illustrated in FIGS. 1-10. Apparatus 20 comprises a housing 28. Housing 28 is generally rectangular in shape having a top, bottom, front, back and sides. A capture hood 30 is usually integrated with housing 28 at the front. Capture hood 30 is located to capture open door emissions 22 from oven 26 when door 32 of the oven is opened. Within housing 28 are contained three chambers; an expansion chamber 34, a condensing chamber 36 and a chilling chamber 38. A sealed exhaust outlet 40 from oven 26 delivers hot air and steam emissions to expansion chamber 34 through emissions inlet 42. When the oven door 32 is closed, these emissions (closed door emissions 24) are pressurized. The pressure-differential forces these emissions to move through expansion chamber 34 where they expand, cool and start to condense. Condensing chamber 36 receives the cooler hot air and steam emissions internally into condensing tubes 44. In condensing chamber 36, most of the emissions are condensed. The now still cooler hot air, steam and condensate 46 are delivered to chilling chamber 38. In chilling chamber 38 any remaining steam is condensed and the condensate temperature lowered to an acceptable level for exhausting to a drain 48. Condensate 46 flows through condensate outlet 50 that exits chilling chamber 38. In parallel the treatment of open door emissions 22 occurs by having the open door emissions drawn into capture hood 30 by fan 52 through hood filter 90. These open door emissions 22 flow through condensing chamber 36 where they cool and condense around condensing tubes 44 and cooling fins 62. Any condensate 46 that forms flows into chilling chamber 38 to be further chilled and drained, while the cooled air exits the back of apparatus 20.

Figure 5:
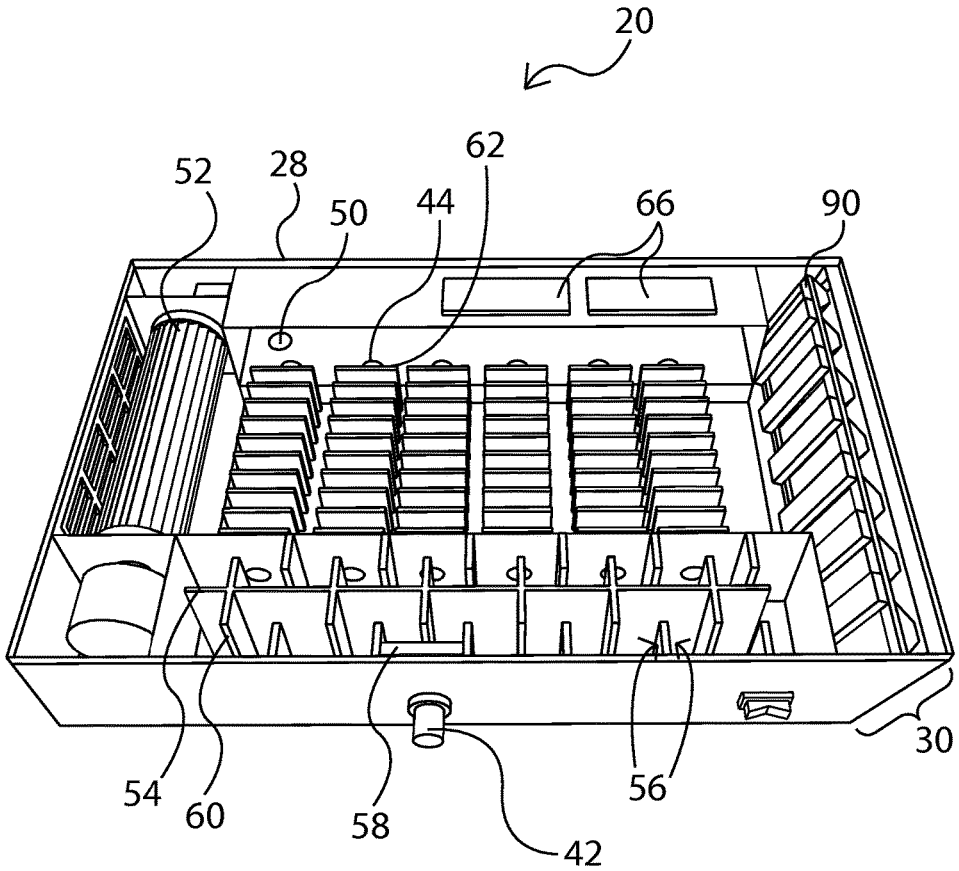
FIG. 5 is a top-side, perspective view of the venting apparatus in FIG. 4 with the top of the housing removed.
Figure 6:
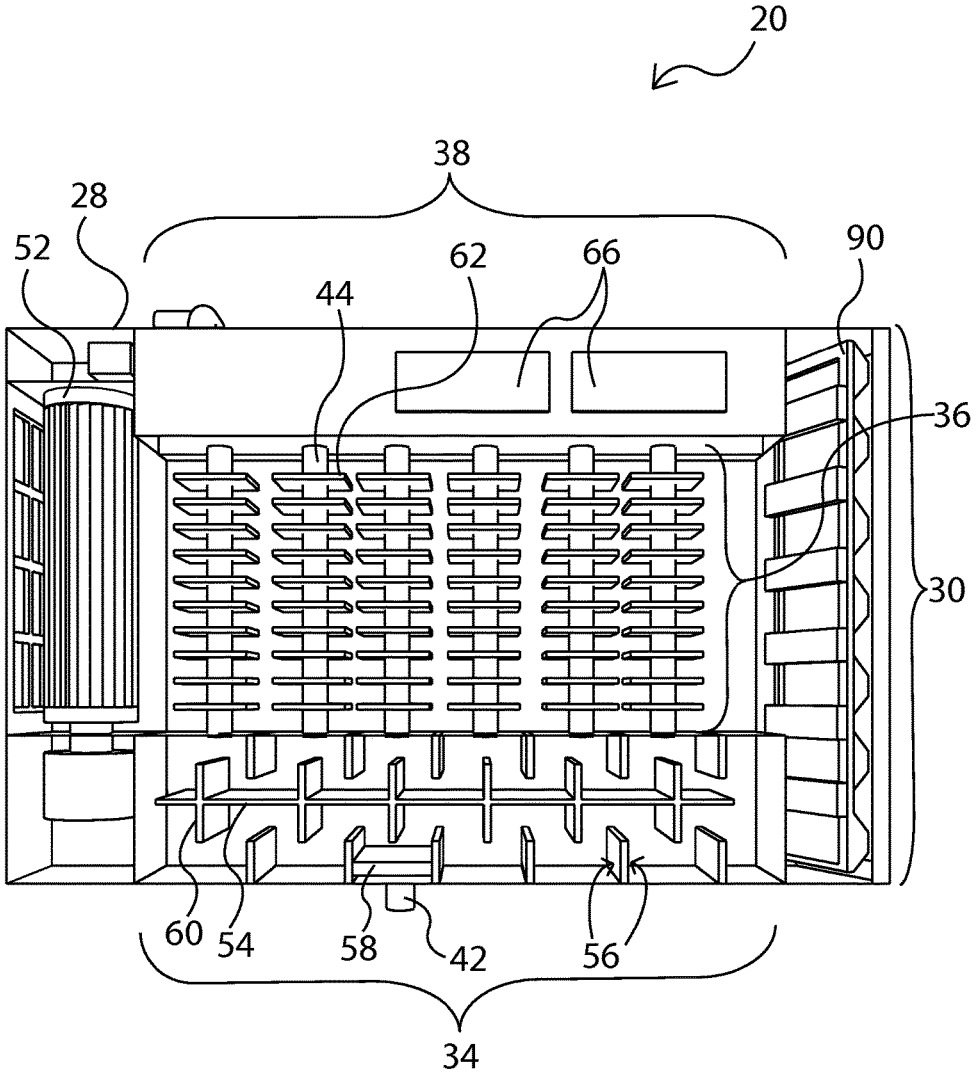
FIG. 6 is a top view of the venting apparatus in FIG. 4 looking into the apparatus with the top of the housing removed.
Figure 9:
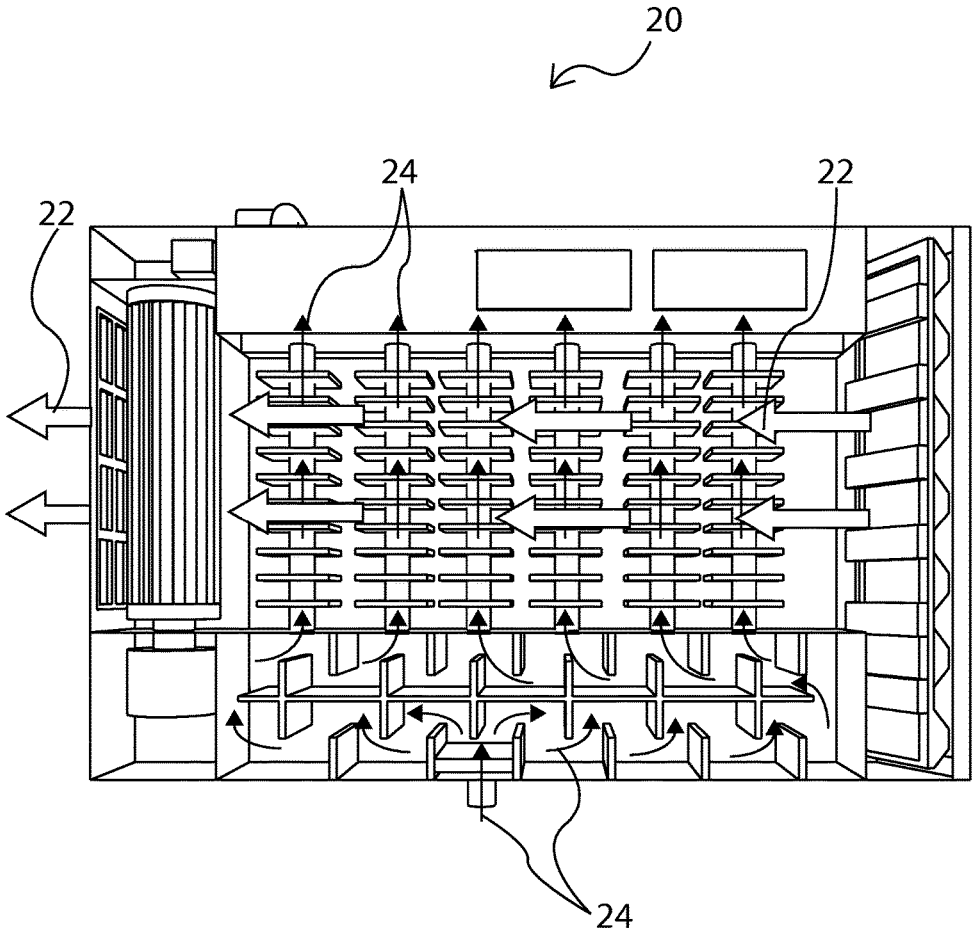
FIG. 9 is the same top view of the venting apparatus in FIG. 6 with emissions flow through the apparatus depicted for emissions captured by both the capture hood and emissions inlet.

The details of expansion chamber 34 are shown in FIGS. 5, 6 and 9. Expansion chamber 34 includes a baffle 54. Baffle 54 has a plurality of baffle surface 56 that create a lengthened path for the hot air and steam (closed door emissions 24) to travel as these emissions pass through expansion chamber 34. In one embodiment baffle surfaces 56 are position at right angles to each other to create a sinuous lengthened path. The hot air and steam enter through emissions inlet 42 and pass through expansion filter 58. Expansion filter 58 removes any grease and other particulates from the emissions. Expansion filter 58 can be removed, cleaned and replaced when contaminated. Once through expansion filter 58, the hot air and steam emissions then travel around each baffle extension 60. While traveling around each baffle extension 60, the pressurized emissions expand and cool. The lengthened back and forth path also provides many opportunities for the cooling gas and particles to condense on baffle 54. The now cooler and partially condensed hot air and steam emissions then exit expansion chamber 34 and enter condensing tubes 44 of condensing chamber 36.

The details of condensing chamber 36 are shown in FIGS. 5-7 and 9. Condensing chamber 36 contains at least one, but preferably a plurality of condensing tubes 44 that run from expansion chamber 34 to chilling chamber 38. Condensing tubes 44 preferably are at a decline from expansion chamber 34 to chilling chamber 38 to facilitate draining of condensate 46 into the chilling chamber. Condensing tubes 44 each have a plurality of cooling fins 62 extending from the outer condensing walls of the condensing tubes. Both condensing tubes 44 and fins 62 are made from high thermal conductivity materials such as metals. Steam and hot air emissions entering each condensing tube 44 are cooled as these emissions pass through the condensing tube. Fan 52 is constantly pulling room temperature air in through capture hood 30 from outside housing 28 to inside the housing and over cooling fins 62, this cooler ambient air is directed externally over condensing tubes 44 to remove excess heat from the condensing tubes to facilitate condensing within the tubes. The still cooler emissions, steam and condensate then flow into chilling chamber 38.

The details of chilling chamber 38 are shown in FIGS. 5, 6, 8 and 9. Chilling chamber 38 is a generally an open chamber with one or more chilling surface 64 (steam chilling surface 64*a* and condensate chilling surface 64*b*). Chilling surface 64 may be any of the surfaces within chilling chamber 38. One or more thermoelectric devices 66 are mounted in contact with a chilling surface 64 to remove heat from the chilling surface. For example, thermoelectric device 66 may be Model No. TE-127-1.0-1.3 from TE Technology, Inc. Chilling chamber 38 includes at least one temperature sensor 68. Temperature sensor 68 monitors the temperature of at least one from the group consisting of a chilling surface of the chilling chamber (surface temperature sensor 70), gases and condensate 46 within the chilling chamber (gas temperature sensor 71), and gases and condensate exiting the chilling chamber (condensate temperature sensor 72). Chilling chamber 38 further includes a switch 74. Switch 74 may itself react directly to the chilling surface temperature within chilling chamber 38 (i.e., a bimetallic snap switch) or the switch may receive temperature information from any of the temperature sensors 68. Switch 74 activates thermoelectric device 66*a* to chill steam chilling surface 64*a* when the chilling surface is above a set temperature. For example, setting switch 74 to activate steam thermoelectric device 66*a* to be ON and removing heat if the temperature at steam chilling surface 64*a* is at 95° C. will ensure that no steam will exit chilling chamber 38. 95° C. is only used as an example; other temperatures could be used as a set point to keep the chilling surface below 100° C. All condensate 46 and cooled air will exit chilling chamber 38 through condensate outlet 50 and into drain 48.

Figure 10:
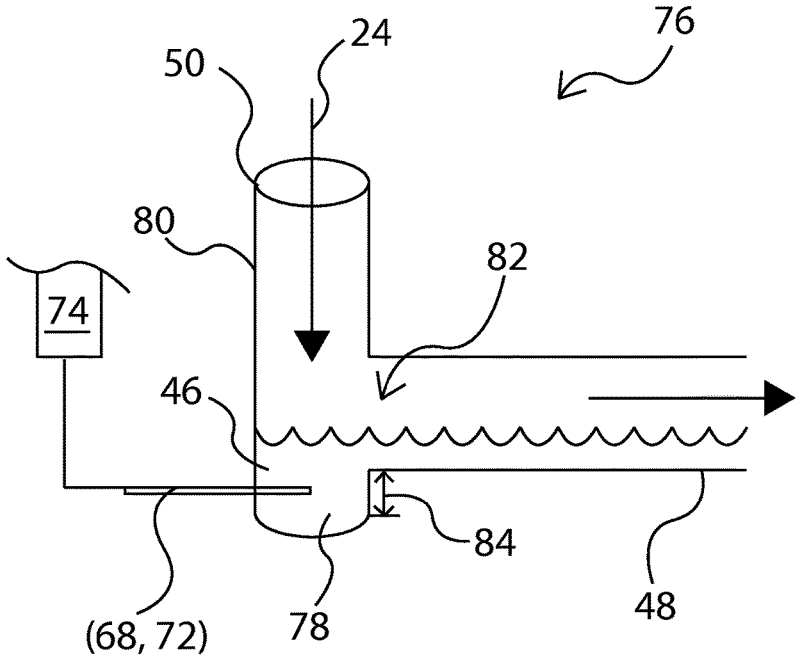
FIG. 10 is side-schematic, sectional view of one embodiment of a condensate switching device.

In one embodiment a condensate switching device 76 may be integrated between condensate outlet 50 and drain 48, FIG. 10. Condensate switching device 76 includes a condensate reservoir 78 in line with said condensate outlet 50 and having a vertical wall 80 with a drain opening 82 located at a vertical height 84. Vertical height 84 determines a set level of condensate 46 within condensate reservoir 78. Condensate temperature sensor 72 is integrated to sense condensate temperature. Switch 74, in communication with condensate temperature sensor 72, is activated to ON for a high-temperature state and OFF for a low-temperature state. The temperature of condensate 46 in condensate reservoir 78 causes switch 74 to turn on and off thermoelectric device(s) 66*b* to insure that condensate temperature is below a specified temperature and does not exit into drain 48 above that specified temperature.

In one embodiment, temperature sensor 68 is two temperature sensors working together. The two temperatures sensors are surface temperature sensor 70 to monitor temperature of chilling surface 64 and condensate temperature sensor 72 to monitor temperature of the condensate. Together the two temperature sensors monitor if steam is present in chilling chamber 38 and the exit temperature of condensate 46 that is exiting chilling chamber 38. Thermoelectric devices 66 are turned on and off independently by surface temperature sensor 70 or condensate temperature 72 sensor to ensure that no steam exits chilling chamber 38 and that the condensate 46 exiting the chilling chamber is less than a set temperature.

Figure 7:
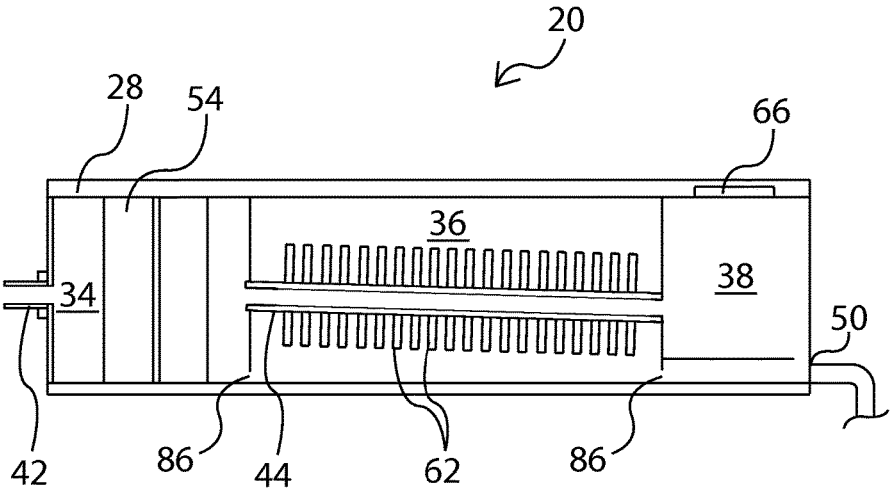
FIG. 7 is a sectional view through a condensing tube of the condensing chamber, the sectional view along line 7-7 of FIG. 4.
Figure 8:
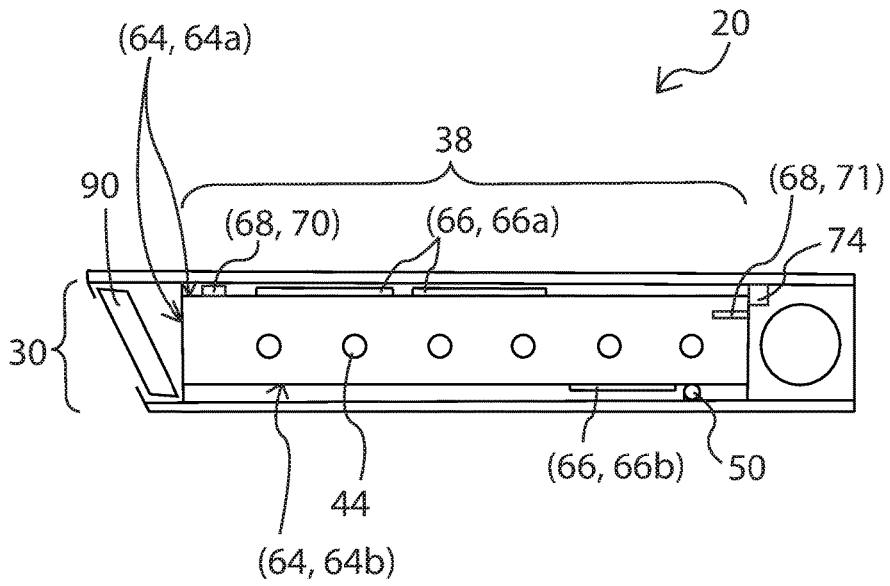
FIG. 8 is a sectional view through the chilling chamber, the sectional view along line 8-8 of FIG. 4.

Drainage gap 86 exists on the bottom of housing 28 between expansion chamber 34, condensing chamber 36 and chilling chamber 38, FIG. 7. Drainage gap 86 allows for all condensate 46 generated in any three of the chambers to flow to chilling chamber 38 and eventually exit through condensate outlet 50.

Capture hood 30 serves two purposes. When door 32 of oven 26 is closed, capture hood 30 allows fan 52 to draw in room temperature air across cooling fins 62 to cool condensing tubes 44. When door 32 is open, capture hood 30 allows fan 52 to draw in open door emissions 24 across cooling fins 62 where they can be cooled. A capture hood filter 90 is provided internal to capture hood 30. Capture hood filter 90 is located after capture hood 30 and prior to condensing chamber 36. Capture hood filter 90 removes any grease and other particulates from the emissions. Capture hood filter 90 can be removed, cleaned and replaced when contaminated.

General operation of apparatus 20 is as follows. When door 32 is closed, closed door emissions 24 (steam and hot air emissions) build up pressure within oven 26. These closed door emissions are force out through sealed exhaust outlet 40 and into emissions inlet 42. As closed door emissions 24 enter expansion chamber 34, they first pass through expansion filter 58 where grease and other particulates are captured. The closed door emissions 24 then expand and cool as they follow a long path around baffle 54. Cooling allows water vapor to condense. The condensation is facilitated by coming in contact with the many surfaces of baffle 54. Any condensate 46 generated drops to the bottom of the chamber and flows through drainage gap 86 towards condensate outlet 50. The now cooler closed door emissions 24 enter condensing tubes 44 of condensing chamber 36. Fan 52 pulls room temperature air over cooling fins 62 to continuously cool condensing tubes 44. Within tubes 44 closed door emissions 24 are further cooled and more condensate 46 is condensed from the emissions. The still cooler closed door emissions 24 and condensate 46 flow out condensing tubes 44 and into chilling chamber 38. Once is chilling chamber 38, the temperature of the air and condensate 46 are measured. If the temperature of the air shows that the air may still contain steam, steam thermoelectric device (s) 66*a* are activated to chill steam chilling surface 64*a*. Also if the temperature of condensate 46 is above an acceptable temperature (usually 82° C.), then condensate thermoelectric device(s) 66*b* are activated to chill condensate chilling surface 64*b* and further cool the condensate. Steam chilling surface 64*a* and condensate chilling surface 64*b* are on opposite sides of the housing walls. All closed door emissions 24 then exit condensate outlet 50 and into drain 48 as either cool air or cool condensate.

When door 32 is open, open door emissions 22 (steam and hot air emissions) exit oven 26 and are collected by capture hood 30. Fan 52 draws in open door emissions 22. Open door emissions 22 first pass through capture hood filter 90 where grease and other particulates are captured. These open door emissions 22 flow through condensing chamber 36 around cooling fins 62 where they cool and condense. Any condensate 46 that forms then drops to the bottom and flows into chilling chamber 38 through drainage gap 86 to be further chilled and drained. The remaining air passes out the back of apparatus 20.

While several embodiments of the invention, together with modifications thereof, have been described in detail herein and illustrated in the accompanying drawings, it will be evident that various further modifications are possible without departing from the scope of the invention. The scope of the claims should not be limited by the preferred embodiments set forth in the examples, but should be given the broadest interpretation consistent with the description as a whole.

What is claimed is:

1. An apparatus for converting hot air and steam emissions into cooler air and condensate, comprising:

a) a housing;

b) an expansion chamber located within said housing;

c) an emissions inlet for delivering the hot air and steam to said expansion chamber;

d) a condensing chamber located within said housing, said condensing chamber containing condensing tubes that receive internally the hot air and steam from said expansion chamber;

e) a capture hood directing cooler ambient air from outside said housing to inside said housing, the cooler ambient air directed externally said condensing tubes to cool said condensing tubes;

f) a chilling chamber located within said housing to receive the hot air and steam from said condensing chamber; and g) a condensate outlet exiting said chilling chamber.

2. An apparatus as recited in claim 1, wherein said expansion chamber includes a baffle.

3. An apparatus as recited in claim 2, wherein said baffle has a plurality of baffle surfaces that create a lengthened path for the hot air and steam to travel as the hot air and steam passes through said expansion chamber.

4. An apparatus as recited in claim 3, wherein said plurality of baffle surfaces creates a lengthened path that is a sinuous lengthened path.

5. An apparatus as recited in claim 3, wherein said plurality of baffle surfaces are positioned at right angles to each other.

6. An apparatus as recited in claim 1, wherein said condensing tubes are positioned to run at a decline from said expansion chamber to said chilling chamber allowing condensate to drain through said condensing tubes into said chilling chamber from said condensing chamber.

7. An apparatus as recited in claim 1, wherein said chilling chamber includes a steam chilling surface and a condensate chilling surface.

8. An apparatus as recited in claim 7, wherein said steam chilling surface and said condensate chilling surface are on opposite sides of the housing walls.

9. An apparatus as recited in claim 7, wherein said chilling chamber includes a steam thermoelectric device for removing heat from said steam chilling surface and a condensate thermoelectric device for removing heat from said condensate chilling surface.

10. An apparatus as recited in claim 9, further including a gas temperature sensor and a condensate temperature sensor, wherein said gas temperature sensor activates said steam thermoelectric device to remove heat from said steam chilling surface and said condensate temperature sensor activates said condensate thermoelectric device to remove heat from said condensate chilling surface, wherein temperatures for the air and condensate exiting the chamber are controlled independently.

11. An apparatus as recited in claim 10, wherein said condensate temperature sensor is set to keep said condensate chilling surface below 82° C.

12. An apparatus as recited in claim 10, wherein said gas temperature sensor is set to keep said steam chilling surface below 100° C.

13. An apparatus as recited in claim 10, wherein said condensate temperature sensor measures condensate temperature of condensate exiting said condensate outlet.

14. An apparatus as recited in claim 10, wherein said gas temperature sensor measures temperature of air exiting said condensate outlet.

15. An apparatus as recited in claim 1, further comprising a condensate drainage gap connecting said expansion chamber, said condensing chamber and said chilling chamber.

16. An apparatus as recited in claim 15, wherein said condensate drainage gap runs at a decline from said expansion chamber to said chilling chamber.

17. An apparatus as recited in claim 1, further comprising an expansion filter between said emissions inlet and said expansion chamber.

18. An apparatus as recited in claim 1, further including a capture hood filter located after said capture hood and prior to said condensing chamber.

19. An apparatus as recited in claim 1, wherein when the hot air and steam is captured by said capture hood the hot air and steam is directed externally over said condensing tubes instead of the cooler ambient air; wherein this hot air and steam are cooled external to said condensing tubes by said condensing tubes.

20. An apparatus as recited in claim 19, further comprising a fan and motor for pulling the hot air and steam through said capture hood and over said condensing tubes within said condensing chamber.

21. An apparatus as recited in claim 1, wherein said condensing tubes have outer condensing walls with cooling fins extending from the outer condensing walls of said condensing tubes.

22. An apparatus as recited in claim 1, wherein said condensing tubes are a plurality of condensing tubes each running directly from said expansion chamber to said chilling chamber through said condensing chamber.

23. An apparatus as recited in claim 22, wherein said plurality of condensing tubes each receive internally a portion of the hot air and steam from said expansion chamber.

* * * * *